US006651409B2

(12) United States Patent
Jones

(10) Patent No.: US 6,651,409 B2
(45) Date of Patent: Nov. 25, 2003

(54) ANGLED RIDING STIRRUP

(76) Inventor: David E. Jones, 34088 FM 2481, Hioo, TX (US) 76457

( * ) Notice: Subject to any disclaimer, the term of this patent is extended or adjusted under 35 U.S.C. 154(b) by 0 days.

(21) Appl. No.: 09/728,533

(22) Filed: Dec. 1, 2000

(65) Prior Publication Data

US 2002/0162306 A1 Nov. 7, 2002

Related U.S. Application Data

(60) Provisional application No. 60/168,885, filed on Dec. 3, 1999.

(51) Int. Cl.[7] ..... B68C 3/00
(52) U.S. Cl. ..... 54/47
(58) Field of Search ..... 54/47, 48, 49, 54/49.5

(56) References Cited

U.S. PATENT DOCUMENTS 33,690 A * 12/1861 Goodman ..... 54/47
33,930 A * 12/1861 Eagle ..... 54/47
38,995 A * 6/1863 Towers ..... 54/47
380,276 A * 3/1888 Butler ..... 54/49
5,172,538 A * 12/1992 Luger ..... 54/47

OTHER PUBLICATIONS

Eastwest/Merryearn Catalog; 1996; pp. 10, B–25, B–26, B–29.

* cited by examiner

*Primary Examiner*—Charles T. Jordan
*Assistant Examiner*—Elizabeth Shaw
(74) *Attorney, Agent, or Firm*—Russell D. Culbertson; Shaffer & Culbertson, L.L.P.

(57) ABSTRACT

A riding stirrup (10) includes a hanger rod (11) for connecting the stirrup to a saddle, and a stirrup loop (12) connected to the hanger rod. The stirrup loop (12) defines a stirrup opening (14) through which a rider may extend their foot when the rider is sitting in the saddle. The stirrup loop (12) also includes an elongated base support tread (17) positioned generally at the bottom of the loop. The base support tread (17) extends at a slant with respect to a stirrup centerline (CL) which extends perpendicular to the longitudinal axis of the hanger rod (11), through a midpoint of the rod, and through the base support tread. This slant places the distance between an outer tread section (21) and the hanger rod (11) greater than the distance between an inner tread section (20) and the hanger rod.

16 Claims, 2 Drawing Sheets

ANGLED RIDING STIRRUP

CROSS-REFERENCE TO RELATED APPLICATION

This application claims the benefit of U.S. Provisional Patent Application No. 60/168,885 entitled "INTENTIONALLY CROOKED STIRRUP," filed Dec. 3, 1999. The entire content of this provisional application is incorporated in the present application.

FIELD OF THE INVENTION

The invention relates to riding gear and, more particularly, to a stirrup for use with a riding saddle, especially a western equestrian riding saddle.

BACKGROUND OF THE INVENTION

The traditional western riding stirrup helps dictate the position of the rider's body and legs while also providing a base of support for the rider. Stirrups are generally used in pairs, with one stirrup hanging on stirrup leathers on each side of the saddle. The stirrups hang from the saddle in position to accept the rider's feed when the rider is sitting in the saddle. Each stirrup includes generally a hanger for connecting to the stirrup leathers, two lateral sides, and a base or tread portion on which the rider's foot actually rests.

Traditionally, a new rider assumes a sitting position in a western saddle and adjusts the stirrup leather length in an attempt to place the bottom or base of each stirrup where it provides the most stability to the rider. Over an extended period of practice, the rider then learns to adjust their foot, leg, and body position to facilitate an acceptable horsemanship quality to the riding position.

There have been many variations in western stirrups. Common variations include variations in the length and width of the tread or base portion of the stirrup. In all of the numerous prior art variations in riding stirrups, however, the rider's weight was unevenly distributed on their feet. Specifically, straddling the horse placed greater pressure on the outer most side of the rider's feet and toes. This uneven pressure on the stirrups often resulted in numbness in the feet, knee, ankle, foot, and leg pain, blisters and general riding discomfort.

Traditional saddles were, and still are, built with a rearward seat pocket and the stirrup leathers hung generally forward on the saddle to allow riders to more easily spread their knees and adjust their leg and foot position to lessen the pressure on the outer edge of each foot. However, this solution to the problem of uneven pressure on prior art stirrups severely degraded the rider's balance. The more pressure that is added to the stirrups to control balance, the more torque is generated, on the feet, to force the riders' knees in toward the horse. The riders' balance is adversely affected since the rider's center of gravity is raised significantly.

The vertical balance saddle which is the subject of U.S. Pat. No. 5,953,889 severely, and by design, restricted the ability of the rider to adjust in the saddle. The saddle forces a pre-defined, good, and effective horsemanship position in the saddle. However, the riding position causes the base (sole) of the rider's feet to tip (horizontally) with the outer edge of each foot considerably lower (closer to the ground) than the inside edge of the foot. These same conditions were also evident to a lesser extent in prior western equestrian saddles.

SUMMARY OF THE INVENTION

It is an object of the invention to provide a riding stirrup which overcomes the above-described problems associated with stirrups used with riding saddles, particularly western riding saddles.

A riding stirrup according to the invention includes a hanger rod for connecting the stirrup to a saddle, and a stirrup loop connected to the hanger rod. The stirrup loop defines a stirrup opening through which a rider may extend their foot when the rider is sitting in the saddle. The stirrup loop includes an elongated base support tread positioned generally at the bottom of the loop. According to the invention, the base support tread extends at a slant with respect to a stirrup centerline which extends perpendicular to the longitudinal axis of the hanger rod, through a midpoint of the rod, and through the base support tread. That is, unlike prior art stirrups, the base support tread according to the present invention does not extend perpendicular to the stirrup centerline.

The base support tread may be thought of as having an inner tread section and an outer tread section. The inner tread section is positioned nearest the horse when the stirrup is in the operating position and is adapted to support the inside of the rider's foot. The outer tread section is farther away from the horse when the stirrup is in the operating position and provides a surface for supporting the outside of the rider's foot. The slant of the base support tread is such that the distance between the inner tread section and hanger rod is less than the distance between the hanger rod and outer tread section. That is, considering a horizontal plane positioned above the level of the base support tread, the base support tread slants away from the plane in the direction from the inner tread section toward the outer tread section.

The inner tread section defines an inner angle with the stirrup centerline which is less than an outer angle defined between the outer tread section and the stirrup centerline. In the preferred form of the invention in which the inner tread section is coplanar with the outer tread section, the inner angle comprises an acute angle whereas the outer angle comprises an obtuse angle.

The angled stirrup base tread according to the invention provides a substantial increase in the rider's balance. The rider's feet more generally fit flat against the base portion of the stirrup giving the rider a very noticeable sense of increased security in the saddle. Also, the rider's center of gravity is lowered since the knees are no longer torqued severely inwardly toward the horse. The riding stirrups according to the invention also help eliminate numbness and pain in the outer edges of the rider's feet and toes, as well as discomfort in the rider's ankles and legs.

When the stirrup according to the present invention is used with a traditional western saddle or the improved saddle described in U.S. Pat. No. 5,953,889 many of the riding instruction techniques used over the years in western riding become unnecessary. That is, the present stirrups dictate many of the correct horsemanship riding position characteristics and eliminate the necessity for the rider to constantly adjust in the saddle to retain a proper riding position.

These and other objects, advantages, and features of the invention will be apparent from the following description of the preferred embodiments, considered along with the accompanying drawings.

DESCRIPTION OF THE PREFERRED EMBODIMENT

Figure 1:
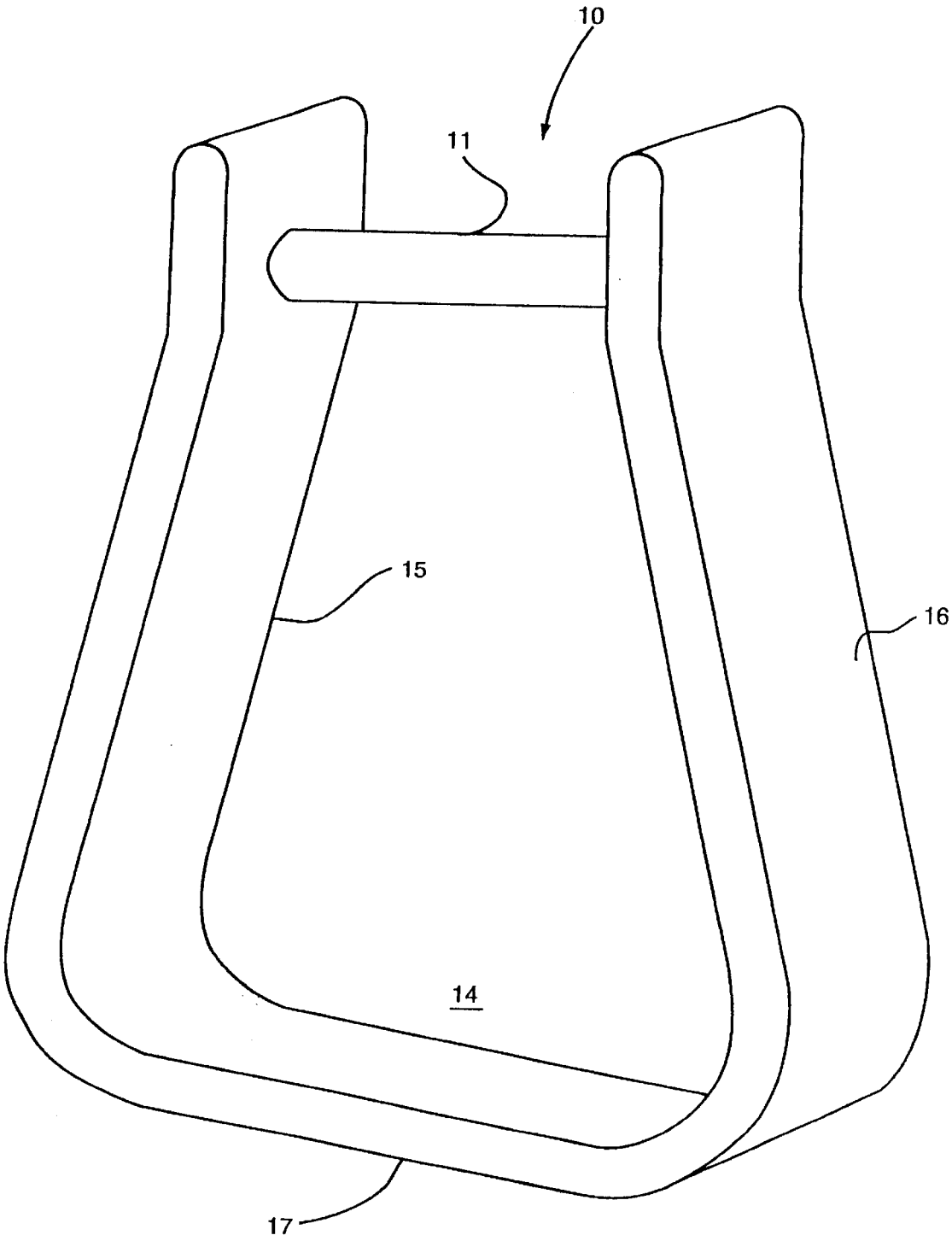
FIG. 1 is a view in perspective of a riding stirrup embodying the principles of the present invention.

A stirrup 10 for use on a western equestrian saddle (not shown) is suspended from the saddle on stirrup leathers (not shown) which receive a stirrup hanger rod 11. Hanger rod 11 is preferably at least 2 inches in length and is connected to a stirrup loop shown generally at reference numeral 12. Stirrup loop 12 defines a loop or stirrup opening 14 through which the rider extends the front portion of their foot when in the riding position. The illustrated stirrup loop 12 includes an interior side 15, an exterior side 16, and an elongated base support tread 17 having longitudinal center axis B shown in FIG. 2. The sides 15 and 16 of the stirrup loop taper outwardly or diverge in the direction from hanger rod 11 toward the base support tread 17.

Stirrups such as the illustrated stirrup 10 are generally used in pairs with one stirrup suspended from each lateral side of the saddle. The interior side 15 of the stirrup is the side of the stirrup that is closest to the horse when in the operating position for the stirrup. The length of interior side 15 is generally shorter than the length of the exterior side 16 due to the angle or slant of base support tread 17. Both interior and exterior side (15 and 16) of the stirrup will be, but not limited to, generally equidistant from a stirrup centerline CL extending substantially perpendicular to the longitudinal axis of hanger rod 11, through a mid point of the stirrup hanger rod, and through the base support tread.

Figure 2:
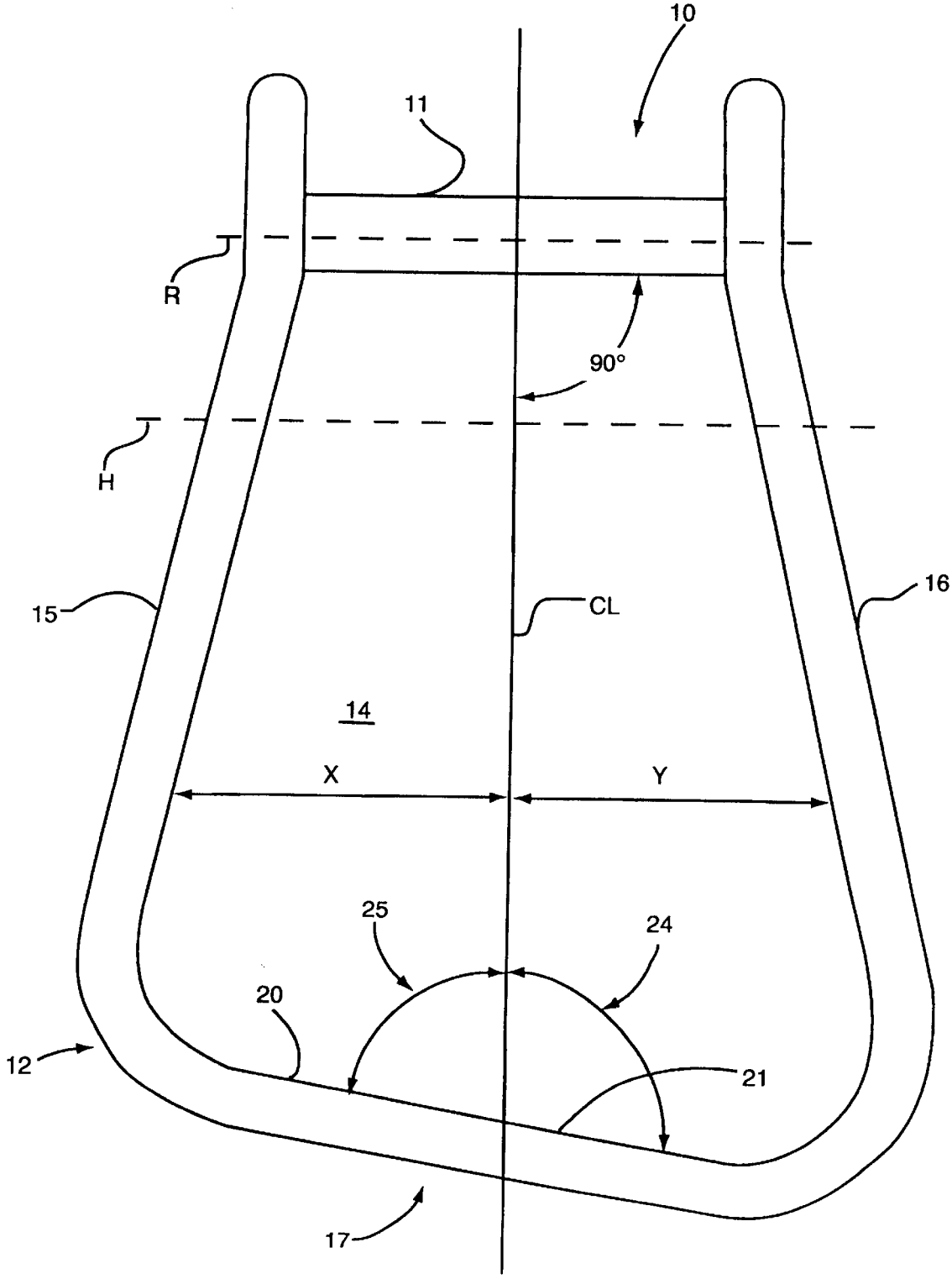
FIG. 2 is a rear view of the stirrup shown in FIG. 1.

As best shown in FIG. 2, base support tread 17 is located, nominally centered, on stirrup centerline CL. Also, base support tread 17 is angled or slanted downwardly from an inner tread section 20 toward an outer tread section 21, away from the horse body when the stirrup is in the operating position. That is, with respect to a horizontal plane H above the level of base support tread 17 when the stirrup 10 is in the operating position, the elongated base support tread slants so that the shortest distance between the upper surface of inner tread section 20 and the horizontal plane is less than the shortest distance between the upper surface of the outer tread section 21 and the horizontal plane. In the preferred form of the invention illustrated in the figures the longitudinal center axis R of hanger rod 11 extends generally horizontally when stirrup 10 is in the operating position. It will also be noted from FIGS. 1 and 2 that in the preferred form of the invention, longitudinal center axis R of hanger rod 11 and longitudinal center axis B of base tread 17 lie in a common plane extending substantially perpendicular to horizontal plane H.

With the angle of the base support tread 17 the upper surface of outer tread section 21 defines an outer angle 24 with respect to stirrup centerline CL which is greater than an inner angle 25 defined by the upper surface of inner tread section 20 and the stirrup centerline. Also, the upper surface of the preferred inner tread section 20 is coplanar with the upper surface of the outer tread section 21 so that the surfaces extend along a straight line with inner angle 24 comprising an acute angle and outer angle 25 comprising an obtuse angle.

The stirrup 10 may be machined from blocks of solid aluminum or cast in aluminum or other suitable metal. Stirrup 10 may also be made from a variety of materials including, but not limited to, wood, plastic, fiberglass or combinations thereof. Protective and/or decorative coverings (not shown) for the stirrups may include rawhide, leather, cloth, paint, silver, gold, bronze, powder coat, combinations of coverings and coatings or simply no covering at all.

The above described preferred embodiments are intended to illustrate the principles of the invention, but not to limit the scope of the invention. Various other embodiments and modifications to these preferred embodiments may be made by those skilled in the art without departing from the scope of the following claims.

What is claimed is:

1. A riding stirrup comprising:

(a) a hanger rod adapted to be received in stirrup leathers for suspending the stirrup from a western equestrian saddle;

(b) a stirrup loop connected to the hanger rod at both ends of the hanger rod and defining a stirrup opening;

(c) an elongated base support tread included in the stirrup loop and spaced apart from the hanger rod, the elongated base support tread including an inner tread section adapted to support an inside portion of a rider's foot and an outer tread section adapted to support an outside portion of the rider's foot, the base support tread also having a longitudinal center axis extending at a slant with respect to a stirrup centerline, the stirrup centerline extending substantially perpendicular to the hanger rod, substantially through a mid point of the hanger rod, and through the base support tread; and (d) wherein the base support tread slants from the inner tread section toward the outer tread section such that the shortest distance between the inner tread section and the longitudinal axis of the hanger rod is less than the shortest distance between the outer tread section and the longitudinal axis of the hanger rod.

2. The riding stirrup according to claim 1 wherein the base support tread includes:

(a) an inner tread section;

(b) an outer tread section; and (c) wherein the base support tread slants from the inner tread section toward the outer tread section such that the shortest distance between the inner tread section and the longitudinal axis of the hanger rod is less than the shortest distance between the outer tread section and the longitudinal axis of the hanger rod.

3. The riding stirrup according to claim 2 wherein:

(a) an upper surface of the inner tread section defines an inner angle with the stirrup centerline;

(b) an upper surface of the outer tread section defines an outer angle with the stirrup centerline; and (c) the inner angle is less than the outer angle.

4. The riding stirrup according to claim 3 wherein the outer angle comprises an obtuse angle and the inner angle comprises an acute angle.

5. The riding stirrup according to claim 4 wherein the upper surface of the inner tread section is substantially coplanar with the upper surface of the outer tread section.

6. The riding stirrup according to claim 1 further including:

(a) an interior side member connecting the hanger rod to the inner tread section; and (b) an exterior side member connecting the hanger rod to the outer tread section; and (c) wherein the interior side member diverges from the exterior side member along the stirrup centerline in the direction from the hanger rod to the base support tread.

7. The riding stirrup of claim 1 wherein the stirrup centerline extends substantially through a mid point of the base support tread.

8. A riding stirrup including:

(a) a hanger rod adapted to be received in stirrup leathers for suspending the stirrup in an operating position from a western equestrian saddle;

(b) a stirrup loop connected to the hanger rod at both ends of the hanger rod and defining a stirrup opening;

(c) an elongated base support tread included in the stirrup loop and spaced apart from the hanger rod, the base support tread including an inner tread section adapted to support an inside portion of a rider's foot and an outer tread section adapted to support an outside portion of the rider's foot; and (d) wherein base support tread is slanted with respect to a horizontal plane which is above the level of the base support tread such that the base support tread slants away from the horizontal plane in the direction from the inner tread section toward the outer tread section when the riding stirrup is oriented in the operating position suspended from the riding saddle.

9. The riding stirrup according to claim 8 wherein:

(a) the base support tread slants in the direction from the inner tread section toward the outer tread section such that the shortest distance between the inner tread section and the horizontal plane is less than the shortest distance between the outer tread section and the horizontal plane.

10. The riding stirrup according to claim 9 wherein:

(a) an upper surface of the inner tread section defines an inner angle with a stirrup centerline extending perpendicular to the horizontal plane;

(b) an upper surface of the outer section defines an outer angle with the stirrup centerline; and (c) the inner angle is less than the outer angle.

11. The riding stirrup according to claim 10 wherein the outer angle comprises an obtuse angle and the inner angle comprises an acute angle.

12. The riding stirrup according to claim 11 wherein the upper surface of the inner tread section is substantially coplanar with the upper surface of the outer tread section.

13. The riding stirrup according to claim 1 further including:

(a) an interior side member connecting the hanger rod to the inner tread section; and (b) an exterior side member connecting the hanger rod to the outer tread section; and (c) wherein the interior side member diverges from the exterior side member along a stirrup centerline in the direction from the hanger rod to the base support tread.

14. The riding stirrup of claim 8 wherein the stirrup centerline extends substantially through a mid point of the base support tread.

15. A riding stirrup comprising:

(a) a hanger rod;

(b) a stirrup loop connected to the hanger rod and defining a stirrup opening; and (c) an elongated base support tread included in the stirrup loop and spaced apart from the hanger rod, the base support tread including an inner tread section adapted to support an inside portion of a rider's foot and an outer tread section adapted to support an outside portion of the rider's foot, the base support tread also having a longitudinal center axis extending at a slant with respect to a stirrup centerline and lying in substantially a common plane with a longitudinal center axis of the hanger rod, the stirrup centerline extending substantially perpendicular to the longitudinal axis of the hanger rod, substantially through a mid point of the hanger rod, and through the base support tread.

16. The riding stirrup of claim 15 wherein the stirrup centerline extends substantially through a mid point of the base support tread.

* * * * *